US011098923B2

(12) United States Patent
Wang

(10) Patent No.: US 11,098,923 B2
(45) Date of Patent: Aug. 24, 2021

(54) ELECTRIC RADIATOR

(71) Applicants: GD MIDEA ENVIRONMENT APPLIANCES MFG CO., LTD., Zhongshan (CN); MIDEA GROUP CO., LTD., Foshan (CN)

(72) Inventor: Xun Wang, Zhongshan (CN)

( * ) Notice: Subject to any disclaimer, the term of this patent is extended or adjusted under 35 U.S.C. 154(b) by 334 days.

(21) Appl. No.: 15/391,320

(22) Filed: Dec. 27, 2016

(65) Prior Publication Data

US 2017/0284701 A1 Oct. 5, 2017

(30) Foreign Application Priority Data

Mar. 31, 2016 (CN) ..... 201610206314.6
Mar. 31, 2016 (CN) ..... 201620268478.7

(51) Int. Cl.
*F24H 3/00* (2006.01)
*F24H 9/20* (2006.01)

(52) U.S. Cl.
CPC ..... *F24H 3/002* (2013.01); *F24H 9/2071* (2013.01); *F24H 2250/00* (2013.01)

(58) Field of Classification Search
CPC ..... F24H 3/002; F24H 9/2071; F24H 2250/00
USPC ..... 392/376
See application file for complete search history.

(56) References Cited

U.S. PATENT DOCUMENTS 568,168 A * 9/1896 Noyes ..... F24H 3/002 392/370
2,230,095 A * 1/1941 Van Daam ..... F24D 13/02 219/202
2,939,807 A * 6/1960 Needham ..... H05B 3/262 216/16
2,978,568 A * 4/1961 Murphy ..... F24H 3/0411 165/57
3,108,170 A * 10/1963 Murphy ..... H05B 3/262 219/217

(Continued)

FOREIGN PATENT DOCUMENTS

CN 2064026 10/1990
CN 203068647 7/2013

(Continued)

OTHER PUBLICATIONS

SIPO, Office Action for CN Application No. 201610206314, dated Jan. 22, 2018.

*Primary Examiner* — Eric S Stapleton
(74) *Attorney, Agent, or Firm* — Kilpatrick Townsend & Stockton, LLP

(57) ABSTRACT

An electric radiator is provided. The electric radiator includes: a housing provided with an air channel cover therein; a heating assembly disposed in the housing and defining a natural convection air channel with the air channel cover, an air supply inlet being formed at a first end of the natural convection air channel and an air supply outlet being formed at a second end of the natural convection air channel above the air supply inlet, air in the natural convection air channel being heated by the heating assembly to form a natural convection in the natural convection air channel; a mesh hood mounted onto a front surface of the housing and covering the heating assembly and the air supply outlet; a first temperature limiter mounted onto the heating assembly and adjacent to the air supply outlet in an up-down direction.

12 Claims, 4 Drawing Sheets

(56) References Cited

U.S. PATENT DOCUMENTS 3,310,046 A * 3/1967 Scott ..... F24C 14/02 126/21 A
3,356,829 A * 12/1967 Brandenburg ..... F24C 7/043 165/128
3,612,825 A * 10/1971 Chase ..... F24C 14/02 126/200
3,829,656 A * 8/1974 Temrin ..... F24H 3/002 165/129
3,889,100 A * 6/1975 Dills ..... F24C 15/006 126/198
4,071,738 A * 1/1978 Jenn ..... F24C 15/325 219/400
4,184,945 A * 1/1980 Morgan ..... H05B 6/642 126/198
4,354,084 A * 10/1982 Husslein ..... F24C 15/006 126/21 A
4,392,048 A * 7/1983 Carter ..... F24H 3/002 165/128
4,493,974 A * 1/1985 Ganek ..... F24H 9/02 165/129
4,622,947 A * 11/1986 Hays ..... F24H 3/087 126/11 OR
4,682,009 A * 7/1987 Meiser ..... F24H 3/002 338/314
4,720,258 A * 1/1988 Berger ..... F17C 7/04 431/208
4,870,253 A * 9/1989 De'Longhi ..... F24H 3/004 392/358
4,912,300 A * 3/1990 Hennuy ..... F24H 3/0417 219/486
5,004,892 A * 4/1991 Goessler ..... H05B 3/72 219/462.1
5,032,706 A * 7/1991 Goessler ..... H05B 3/742 219/462.1
5,113,170 A * 5/1992 Goessler ..... F24C 15/105 219/448.19
5,761,377 A * 6/1998 Wolfe ..... F24H 3/0417 392/373
5,966,498 A * 10/1999 Kirchner ..... F24D 19/0002 219/540
6,631,243 B2 * 10/2003 Reiker ..... F04D 25/088 392/364
6,693,261 B2 * 2/2004 Leutner ..... F24C 15/04 126/190
6,760,543 B1 * 7/2004 Orr ..... F24H 3/0417 392/360
7,158,716 B2 * 1/2007 Shapiro ..... F04D 17/04 392/365
7,228,857 B2 * 6/2007 Kim ..... F24C 15/006 126/198
7,288,743 B1 * 10/2007 Kim ..... F24C 15/322 219/391
8,141,549 B2 * 3/2012 Armstrong ..... F24C 15/006 126/190
8,447,176 B2 * 5/2013 McCourt ..... F24D 13/02 392/347
8,467,668 B2 * 6/2013 Searle ..... F24H 3/0417 219/210
9,036,986 B2 * 5/2015 Amberson ..... F24H 3/0411 219/494
9,976,773 B2 * 5/2018 Stinson ..... F24H 3/002
2002/0064380 A1 * 5/2002 Reiker ..... F04D 25/088 392/364
2002/0076213 A1 * 6/2002 Pelonis ..... F24D 19/0087 392/358
2003/0066638 A1 * 4/2003 Qu ..... C09K 5/14 165/186
2006/0018640 A1 * 1/2006 Hinesley ..... F24C 15/22 392/420
2007/0163094 A1 * 7/2007 Wright ..... D06F 58/203 28/100
2007/0163096 A1 * 7/2007 McAllister ..... D06F 58/203 28/100
2007/0163097 A1 * 7/2007 Metcalfe ..... D06F 58/203 28/100
2007/0163098 A1 * 7/2007 Tomasi ..... D06F 58/203 28/100
2009/0229598 A1 * 9/2009 Cao ..... B09B 3/0041 126/617
2011/0016928 A1 * 1/2011 Beihoff ..... D06F 58/203 68/19
2012/0152931 A1 * 6/2012 Bohlender ..... F24H 3/0405 219/520
2013/0251353 A1 * 9/2013 Amberson ..... F24H 3/0411 392/365
2015/0168012 A1 * 6/2015 Amberson ..... F24H 3/0411 392/377

FOREIGN PATENT DOCUMENTS

CN 104344448 2/2015
CN 204593541 8/2015
CN 205641112 10/2016
GB 1471280 4/1977

* cited by examiner

ELECTRIC RADIATOR

CROSS-REFERENCE TO RELATED APPLICATIONS

This application claims priority to and benefits of Chinese Patent Application Serial Nos. 201610206314.6 and 201620268478.7, both filed with the State Intellectual Property Office of P. R. China on Mar. 31, 2016, the entire contents of which are incorporated herein by reference.

FIELD

The present disclosure relates to the field of household appliance manufacturing technology, more particularly to an electric radiator.

BACKGROUND

In the related art, an electric radiator, in particularly a far infrared electric radiator may form a forced convection by using an electric motor to drive apparatuses such as a fan, so as to decrease a temperature, thus resulting in problems of a complex structure, high cost and high energy consumption. Moreover, if the air is blocked and may not be discharged, an accident may happen due to a high temperature. For example, when a towel is covered on the electric radiator, a process of discharging the air may be affected, inside temperature may continue to increase and thus easily causes an accident such as a fire.

SUMMARY

Embodiments of the present disclosure seek to solve at least one of the problems existing in the related art to at least some extent. Accordingly, an object of the present disclosure is to provide an electric radiator with advantages of a simple structure, low cost and low energy consumption, and if air to be discharged is blocked, the electric radiator may stop heating, so as to achieve a higher use safety.

The electric radiator according to an embodiment of the present disclosure includes: a housing provided with an air channel cover therein; a heating assembly disposed in the housing and defining a natural convection air channel with the air channel cover, an air supply inlet being formed at a first end of the natural convection air channel and an air supply outlet being formed at a second end of the natural convection air channel above the air supply inlet, air in the natural convection air channel being heated by the heating assembly to form a natural convection in the natural convection air channel; a mesh hood mounted onto a front surface of the housing and covering the heating assembly and the air supply outlet; a first temperature limiter mounted onto the heating assembly and adjacent to the air supply outlet in an up-down direction.

In the electric radiator according to an embodiment of the present disclosure, the heating assembly is used to heat the air in the natural convection air channel to form the natural convection therein, so that air guide apparatuses such as an electric motor and a fan may be omitted, and thus the structure is simpler, the cost is lower and the energy consumption is lower. Moreover, the first temperature limiter is adjacent to the air supply outlet in the up-down direction, so that when a towel test is performed, that is, when the temperature is over high because the electric radiator is covered by obstacles such as clothes, the electric radiator can stop heating so as to ensure the safety.

Additionally, the electric radiator according to the present disclosure further has additional technical features as follows:

In some embodiments of the present disclosure, the electric radiator further includes: a second temperature limiter mounted in the housing and adjacent to a front wall of the housing and to the air supply inlet in the up-down direction.

In some embodiments of the present disclosure, the heating assembly includes: a reflector disposed in the housing and defining the natural convection air channel with the air channel cover, the air supply outlet being formed at the reflector and the air supply inlet being formed at the housing; a heating unit, the heating unit and the first temperature limiter being mounted onto the reflector respectively and facing to the mesh hood.

Alternatively, the air channel cover is located behind the reflector.

Alternatively, a plurality of the heating units are provided and each of the heating units is extended in the up-down direction, and the plurality of the heating units are spaced apart from each other in a left-right direction, the first temperature limiter is located in a middle of the plurality of the heating units in the left-right direction.

In some embodiments of the present disclosure, an isolation rib is disposed on the reflector and defines a receiving groove facing to the mesh hood, the heating unit is assembled in the receiving groove and the first temperature limiter is mounted onto the isolation rib.

Furthermore, a mounting groove is formed at the isolation rib, faces to the mesh hood and runs through the isolation rib in a thickness direction of the isolation rib, and the first temperature limiter is mounted in the mounting groove.

In some embodiments of the present disclosure, the air supply outlet is located at a top of the housing and faces forwards, the air supply inlet is located at a bottom of the housing and faces backwards, the second temperature limiter is located at a bottom front of the first temperate limiter.

Preferably, the second temperature limiter is located below the mesh hood and in a middle of the housing in a left-right direction.

In an alternative embodiment of the present disclosure, the housing includes: a front housing body, the heating assembly, the mesh hood and the second temperature limiter are mounted onto the front housing body respectively; a rear housing body mounted onto the front housing body detachably, the air supply inlet being formed at the rear housing body.

Additional aspects and advantages of embodiments of present disclosure will be given in part in the following descriptions, become apparent in part from the following descriptions, or be learned from the practice of the embodiments of the present disclosure.

Figure 1:
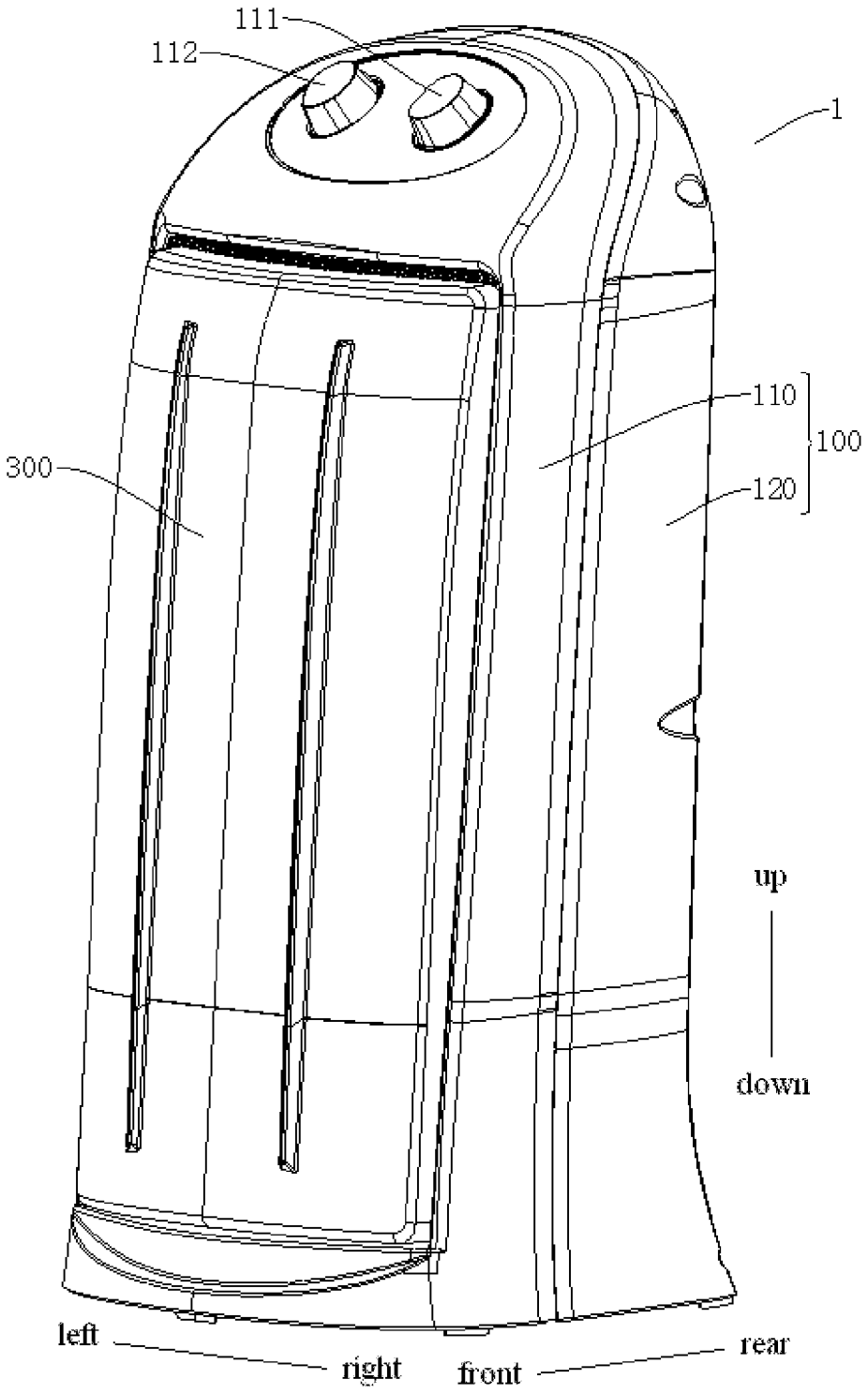
FIG. 1 is a perspective view of an electric radiator according to an embodiment of the present disclosure.

REFERENCE NUMERALS housing 100, natural convection air channel 101, air supply inlet 102, air supply outlet 103, front housing body 110, switch 111, temperature adjusting knob 112, rear housing body 120, heating assembly 200, reflector 210, isolation rib 211, heating unit 220, mesh hood 300, first temperature limiter 400, second temperature limiter 500, air channel cover 600, heat insulation component 700, power line 800.

DETAILED DESCRIPTION

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

With reference to FIG. 1 to FIG. 4, an electric radiator 1 according to embodiments of the present disclosure is described. In an embodiment, the electric radiator 1 is a far infrared electric radiator. The electric radiator 1 may stop heating if the air to be discharged is blocked, thus having a higher use safety.

As shown in FIG. 1 to FIG. 4, the electric radiator 1 according to embodiments of the present disclosure includes a housing 100, an air channel cover 600, a heating assembly 200, a mesh hood 300 and a first temperature limiter 400.

Specifically, the housing 100 is provided with the air channel cover 600 therein, and the air channel cover 600 may be a separate component mounted in the housing 100 and may also be formed integrally with the housing 100. The heating assembly 200 is disposed in the housing 100 and defines a natural convection air channel 101 with the air channel cover 600. An air supply inlet 102 is formed at a first end of the natural convection air channel 101 and an air supply outlet 103 is formed at a second end of the natural convection air channel 101, in which the air supply outlet 103 is located above the air supply inlet 102. Air in the natural convection air channel 101 is heated by the heating assembly 200 to form a natural convection in the natural convection air channel 101. The mesh hood 300 is mounted onto a front surface of the housing 100 and covers the heating assembly 200 and the air supply outlet 103. The first temperature limiter 400 is mounted onto the heating assembly 200 and adjacent to the air supply outlet 103 in an up-down direction.

With reference to drawings, a working process of the electric radiator 1 according to embodiments of the present disclosure is described.

Figure 4:
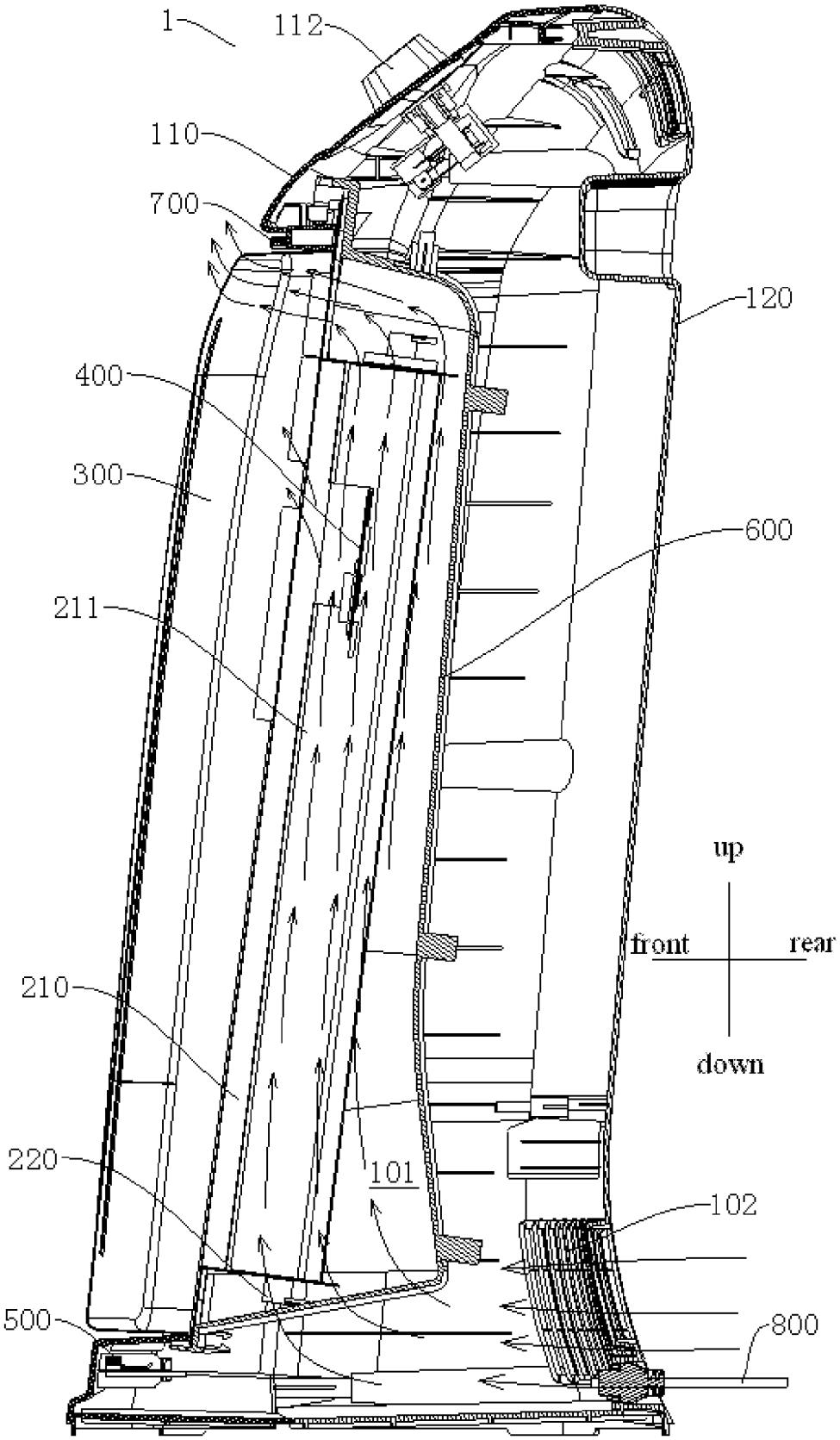
FIG. 4 is a schematic view of a natural convection of an electric radiator according to an embodiment of the present disclosure.

When the electric radiator 1 is working normally, the air in the natural convection air channel 101 is heated by the heating assembly 200, and the heated air in the natural convection air channel 101 may rise and may be discharged out of the natural convection air channel 101 from the air supply outlet 103 and meanwhile air at a room temperature may enter into the natural convection air channel 101 from the air supply inlet 102, thus forming the natural convection in the natural convection air channel 101 without additional air guide apparatuses such as an electric motor and a fan. The natural convection may contribute to a decrease in a normal working temperature of the first temperature limiter 400, so as to prevent the first temperature limiter 400 from being mistakenly started. FIG. 4 shows a flow direction of the air in the natural convection air channel 101.

If objects such as towel are covered on the electric radiator 1, on one hand, a passageway of the natural convection is blocked because the air supply outlet 103 is covered by the towel, so that the temperature at the first temperature limiter 400 may be increased quickly, and on the other hand, after the electric radiator 1 is covered by the towel, in a sealed space formed above the mesh hood 300 and the heating assembly 200, heat is difficult to dissipate, which further increases the temperature of the first temperature limiter 400, and thus an action is performed by the first temperature limiter 400 and the electric radiator 1 may stop heating.

It should be understood by the skilled person in the art that one air supply outlet 103 or a plurality of the air supply outlets 103 may be provided, and no matter how many the air supply outlet(s) 103 may be, the natural convection air channel 101 is ensured to have a sufficient air supply area, so that an effect of the natural convection in the natural convection air channel 101 and an effect of decreasing the temperature of the first temperature limiter 400 by the natural convection may be achieved.

In conclusion, in the electric radiator 1 according to embodiments of the present disclosure, the heating assembly 200 and the air channel cover 600 define the natural convection air channel 101 together, and the air in the natural convection air channel 101 may be heated directly by the heating assembly 200 so as to form the natural convection. On one hand, air guide apparatuses such as an electric motor and a fan may be omitted, so that the structure is simplified, the cost is lowered, and the energy consumption is decreased. On the other hand, the temperature inside a normally working electric radiator 1 may be effectively decreased and a temperature limiter may be located, so that the first temperature limiter 400 may be mounted onto the heating assembly 200 and adjacent to the air supply outlet 103 in an up-down direction. In such a way, if the electric radiator 1 is covered by obstacles such as clothes so as to reach an over-high temperature, the electric radiator 1 may stop heating, and thus the safety is ensured and the electric radiator 1 may pass a towel test in the safety requirement.

It should be understood by the skilled person in the art that the temperature limiter may be directly communicated with the heating assembly, and may also be indirectly communicated with the heating assembly via a controller. When a temperature value of the temperature limiter reaches a safety limit value, a signal may be sent to the heating assembly or the controller to stop the heating of the heating assembly.

Figure 2:
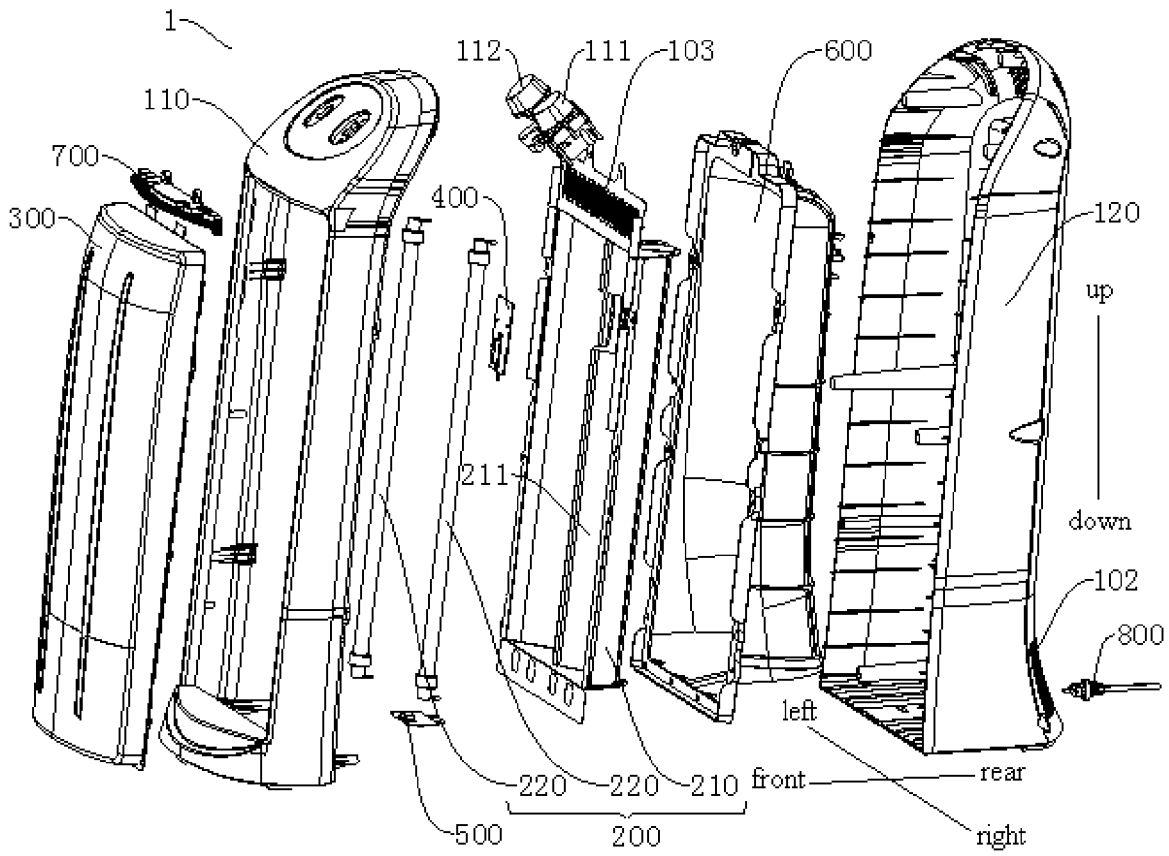
FIG. 2 is an exploded view of an electric radiator according to an embodiment of the present disclosure.
Figure 3:
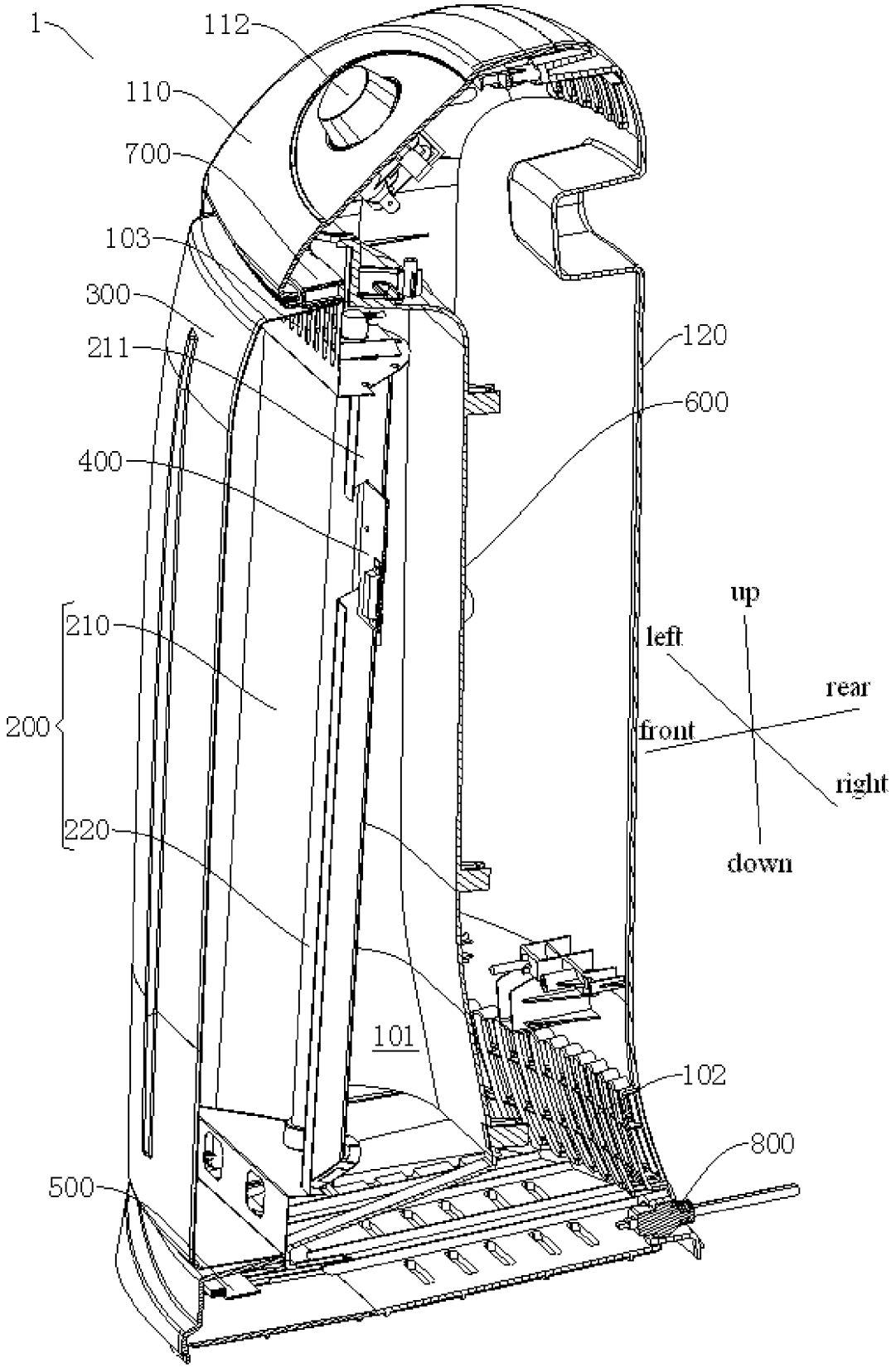
FIG. 3 is a sectional view of an electric radiator according to an embodiment of the present disclosure.

In some embodiments of the present disclosure, as shown in FIG. 2 to FIG. 4, the electric radiator 1 may further include a second temperature limiter 500. The second temperature limiter 500 is mounted in the housing 100 and adjacent to a front wall of the housing 100 and to the air supply inlet 102 in the up-down direction. When the electric radiator 1 is working normally, because the whole electric radiator 1 is not blocked in the front, good effect of heat dissipation may be achieved at the second temperature limiter 500, so that the temperature at the second temperature limiter 500 is lower. When the electric radiator 1 is blocked in the front (e.g., by a wall), on one hand, a rate of the heat dissipation at the second temperature limiter 500 may be decreased, and the temperature of the second temperature limiter 500 may be increased significantly, and on the other hand, the thermal radiation of the heating assembly 200 may be reflected by the obstacle in the front of the whole electric radiator 1, so that the temperature of the second temperature limiter 500 may be increased, thus an action is performed by the second temperature limiter 500 and the electric radiator 1 may stop heating.

In such a way, the electric radiator 1 according to the embodiments of the present disclosure may stop heating when it is blocked in the front, thus further improving the use safety. Therefore, the electric radiator 1 may pass a wall test in the safety requirement. Moreover, the first temperature limiter 400 and the second temperature limiter 500 may not interfere with each other.

Specifically, as shown in FIG. 2 to FIG. 4, the heating assembly 200 may include a reflector 210 and a plurality of heating units 220. The reflector 210 is disposed in the housing 100 and defines the natural convection air channel 101 with the air channel cover 600. The air supply outlet 103 is formed at the reflector 210 and the air supply inlet 102 is formed at the housing 100. The plurality of heating units 220 and the first temperature limiter 400 are mounted onto the reflector 210 respectively and face to the mesh hood 300. In other words, the natural convection air channel 101 may be formed on the whole reflector 210. Thus, the reflector 210 not only may transfer a small part of heat of the heating units 220 into the natural convection air channel 101 so as to form the natural convection in the natural convection air channel 101, but also may reflect most of the heat of the heating units 220 to the front of the electric radiator 1 to supply heat, so as to make a full use of the heat generated by the heating units 220, thus further decreasing the energy consumption.

Alternatively, as shown in FIG. 2 to FIG. 4, the air channel cover 600 is located behind the reflector 210. In such a way, air at a room temperature may enter between the reflector 210 and the air channel cover 600 from the air supply inlet 102, and may be heated by the plurality of the heating units 220. After that, the heated air may be discharged from the air supply outlet 103. On one hand, the natural convection may be formed by the heat transferred by the reflector 210, and on the other hand, it may be avoided that heat supply of the electric radiator 1 is interrupted by the natural convection air channel 101.

Alternatively, as shown in FIG. 2 to FIG. 4, each of the heating units 220 is extended in the up-down direction, and the plurality of the heating units 220 are spaced apart from each other in a left-right direction, and the first temperature limiter 400 is located in a middle of the plurality of the heating units 220 in the left-right direction, so that the first temperature limiter 400 is sensitive and the safe reliability of the electric radiator 1 is higher. For example, there are two heating units 220 and the first temperature limiter 400 is located in the middle of the two heating units 220 in the left-right direction. It should be noted that, in the case that the heating unit 220 is extended in the up-down direction, a case that the heating unit 220 is inclined in a vertical plane is included. For example, the reflector 210 is inclined from the bottom to the top and from the front to the rear, i.e., the reflector 210 is tilted backwards, and the heating unit 220 may be inclined with the reflector 210 in a vertical plane, so that the natural convection air channel 101 is inclined, thus increasing air volume and avoiding the over-high temperature of the ground radiated by the heating unit 220.

In some embodiments shown in FIG. 2 to FIG. 4, an isolation rib 211 is disposed on the reflector 210 and defines a plurality of receiving grooves, and the number of the receiving grooves is corresponding to that of the heating units 220 and the receiving grooves face to the mesh hood 300. The plurality of heating units 220 are assembled in the plurality of receiving grooves respectively and the first temperature limiter 400 is mounted onto the isolation rib 211.

Furthermore, a mounting groove is formed at the isolation rib 211, faces to the mesh hood 300 and runs through the isolation rib 211 in a thickness direction of the isolation rib 211, and the first temperature limiter 400 is mounted in the mounting groove. For example, the mounting groove has a forward opening and runs through the isolation rib 211 in the left-right direction, so that the first temperature limiter 400 may be fixed onto the isolation rib 211 more firmly.

In some specific embodiments of the present disclosure, as shown in FIG. 2 to FIG. 4, the air supply outlet 103 is located at a top of the housing 100 and faces forwards, the air supply inlet 102 is located at a bottom of the housing 100 and faces backwards, and the second temperature limiter 500 is located at a bottom front of the first temperate limiter 400, such that the air at a room temperature may enter into the natural convection air channel 101 from the bottom and the heated air may be discharged out of the natural convection air channel 101 from the top, thus achieving a better natural convection effect. Preferably, as shown in FIG. 3 and FIG. 4, the second temperature limiter 500 is located below the mesh hood 300 and in the middle of the housing 100 in the left-right direction, i.e., the second temperature limiter 500 may not be located in the natural convection air channel 101. Thus, an influence of the temperature in the natural convection air channel 101 on the second temperature limiter 500 may be reduced significantly, so that the action of the second temperature limiter 500 may be quicker and more accurate and the safe reliability of the electric radiator 1 may be higher.

It should be understood that, a power line 800 may be provided in and pass through the housing 100. The power line 800 may be in electric connection with the first temperature limiter 400 and the second temperature limiter 500 respectively, so as to realize the protection action of the first temperature limiter 400 and the second temperature limiter 500. Preferably, the power line 800 may be mounted onto the bottom of the housing 100, so that line arrangement is convenient and may not affect the installation of the electric radiator 1.

In an alternative embodiment of the present disclosure, as shown in FIG. 1 to FIG. 4, the housing 100 may include a front housing body 110 and a rear housing body 120. The heating assembly 200, the mesh hood 300 and the second temperature limiter 500 are mounted onto the front housing body 110 respectively, and the rear housing body 120 is detachably mounted onto the front housing body 110 and the air supply inlet 102 is formed at the rear housing body 120, thus facilitating the installation. Specifically, a switch 111, which is configured to turn on or turn off the electric radiator 1, and a temperature adjusting knob 112, which is configured to adjust a heating temperature of the electric radiator 1, may be provided on the front housing body 110. Preferably, a heat insulation component 700 may be provided between the top of the mesh hood 300 and the front housing body 110, thus preventing the front housing body 110 from being damaged by the high temperature of the mesh hood 300.

With reference to drawings, an electric radiator 1 according to a specific embodiment of the present disclosure is described in detail as follows. It should be understood that the following description is illustrative, and shall not be construed to limit the present disclosure.

As shown in FIG. 1 to FIG. 4, the electric radiator 1 according to embodiments of the present disclosure includes a housing 100, a heating assembly 200, a mesh hood 300, a first temperature limiter 400, a second temperature limiter 500 and an air channel cover 600.

Specifically, the housing 100 includes a front housing body 110 and a rear housing body 120 which are inclined from the bottom to the top and from the front to the rear respectively. The switch 111 and the temperature adjusting knob 112 are disposed on the front housing body 110 respectively. The rear housing body 120 is detachably mounted onto the front housing body 110 and the air supply inlet 102 is formed at a bottom of the rear housing body 120 and faces backwards. The heating assembly 200 includes a reflector 210 and two heating units 220. The reflector 210 is mounted onto the front housing body 110 and located inside the housing 110. The air supply outlet 103 is formed at the top of the reflector 210 and located above the air supply inlet 102 and faces forwards. The mesh hood 300 is mounted onto the front housing body 110 and covers the heating assembly 200 and the air supply outlet 103. A heat insulation component 700 is provided between the top of the mesh hood 300 and the front housing body 110. An isolation rib 211 is disposed on a front surface of the reflector 210 and extends essentially in the up-down direction. The isolation rib 211 defines two receiving grooves arranged on the reflector 210 in the left-right direction, and the two heating units 220 are mounted into the two receiving grooves respectively. The air channel cover 600 is disposed in the housing 100 and located behind the reflector 210, and thus the natural convection air channel 101 is defined between the reflector 210 and the air channel cover 600. Specifically, the reflector 210 and the air channel cover 600 are tilted backwards respectively, so that the natural convection air channel 101 is inclined in the vertical plane.

The mounting groove is formed at the isolation rib 211, faces forwards and runs through the isolation rib 211 in the left-right direction, and the first temperature limiter 400 is mounted in the mounting groove. The first temperature limiter 400 is located at an upper portion of the reflector 210 and in the middle of the two heating units 220 in the left-right direction. The second temperature limiter 500 is disposed in the housing 100 and located below the mesh hood 300, and located in the middle of the front housing body 110 in the left-right direction and at a bottom front of the first temperature limiter 400. The power line 800 is mounted at the bottom of the rear housing body 120 and is in electric connection with the first temperature limiter 400 and the second temperature limiter 500 respectively.

With reference to drawings, the working process of the electric radiator 1 according to the embodiments of the present disclosure may be described.

When the electric radiator 1 is working normally, the air in the natural convection air channel 101 is heated by the two heating units 220 through the reflector 210. The heated air in the natural convection air channel 101 may rise and may be discharged out of the natural convection air channel 101 from the air supply outlet 103, meanwhile the air at a room temperature may enter into the natural convection air channel 101 from the air supply inlet 102, thus forming the natural convection in the natural convection air channel 101. The natural convection may contribute to a decrease in the temperature of the first temperature limiter 400. FIG. 4 shows a flow direction of the air in the natural convection air channel 101.

When the towel test is performed, the towel covers the electric radiator 1, on one hand, a passageway of the natural convection is blocked because the air supply outlet 103 is covered by the towel, so that temperature at the first temperature limiter 400 may be increased quickly, and on the other hand, after the electric radiator 1 is covered by the towel, in a sealed space formed above the mesh hood 300 and the reflector 210, heat is difficult to dissipate, which further increases the temperature of the first temperature limiter 400, and thus an action is performed by the first temperature limiter 400 and the electric radiator 1 may stop heating.

When the wall test is performed, an obstacle is provided in front of the electric radiator 1, on one hand, a rate of the heat dissipation at the second temperature limiter 500 may be decreased, and the temperature of the second temperature limiter 500 may be increased significantly, and on the other hand, the thermal radiation of the reflector 210 and the heating unit 220 may be reflected by the obstacle in front of the whole electric radiator 1, so that the temperature of the second temperature limiter 500 may be increased, and thus an action is performed by the second temperature limiter 500 and the electric radiator 1 may stop heating.

In conclusion, in a far-infrared electric radiator 1 according to the present disclosure, the air between the reflector 210 and the air channel cover 600 may be heated by the heating unit 220 and the reflector 210, so as to form the natural convection in the natural convection air channel 101. At the same time, the first temperature limiter 400 is disposed at the upper portion of the reflector 210, the second temperature limiter 500 is disposed at the bottom of the front housing body 110, and the second temperature limiter 500 is located at the bottom front of the first temperate limiter 400, so as to pass the towel test and the wall test. That is, under both situations that the electric radiator 1 is covered by obstacles such as clothes and blocked by obstacles such as a wall in the front, the electric radiator 1 may stop heating so as to ensure the safety. In the far-infrared electric radiator 1 according to an embodiment of the present disclosure, the air guide apparatuses such as an electric motor and a fan are omitted, so that the structure is simpler, the cost is lower and the energy consumption is lower.

Other structures and operations of the electric radiator 1 according to embodiments of the present disclosure are known to a skilled person in the art, which is no more described in detail herein.

In the specification, unless specified or limited otherwise, relative terms such as "central", "thickness", "up", "down", "front", "rear", "right", "left", "horizontal", "vertical", "top", "bottom", "inner" and "outer" should be construed to refer to the orientation as then described or as shown in the drawings under discussion. These relative terms are for convenience of description and do not require that the present disclosure be constructed or operated in a particular orientation. In addition, terms such as "first" and "second" are used herein for purposes of description and are not intended to indicate or imply relative importance or significance. Thus, features limited by "first" and "second" are intended to indicate or imply including one or more than one these features. In the description of the present disclosure, "a plurality of" relates to two or more than two.

In the description of the present disclosure, unless specified or limited otherwise, it should be noted that, terms "mounted," "connected" and "communicated" may be understood broadly, such as permanent connection or detachable connection, electronic connection or mechanical connection, direct connection or indirect connection via intermediary, inner communication or inter reaction between two elements. These having ordinary skills in the art should understand the specific meanings in the present disclosure according to specific situations.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. An electric radiator, comprising:

a housing provided with an air channel cover therein;

a heating assembly disposed in the housing and defining a natural convection air channel with the air channel cover, an air supply inlet being formed at a first end of the natural convection air channel and an air supply outlet being formed at a second end of the natural convection air channel above the air supply inlet, air in the natural convection air channel being heated by the heating assembly to form a natural convection in down to up direction in the natural convection air channel without electric fan;

a mesh hood mounted onto a front surface of the housing and covering the heating assembly and the air supply outlet;

a first temperature limiter mounted onto the heating assembly and adjacent to the air supply outlet in an up-down direction, the first temperature limiter being configured to turn off the heating assembly when temperature of the first temperature limiter reaches a first temperature limit; and a second temperature limiter mounted in the housing and adjacent to a front wall of the housing, wherein the second temperature limiter is configured to turn off the heating assembly when temperature of the second temperature limiter reaches a second temperature limit;

wherein the air supply inlet and the air supply outlet are disposed at opposite sides of the housing, the air supply inlet is located at a bottom of the housing and faces backwards, the air supply outlet is located at a top of the housing and faces forwards;

wherein the heating assembly and the air channel cover are tilted backwards, and the natural convection air channel is inclined in a vertical plane.

2. The electric radiator according to claim 1, wherein the heating assembly has an opening that opens forward, and the air supply outlet is located above the opening and spaced from the opening.

3. The electric radiator according to claim 1, wherein the second temperature limiter is located below the mesh hood, wherein the heating assembly comprises:

a reflector configured to reflect heat, the reflector being disposed in the housing and defining the natural convection air channel with the air channel cover;

a heater being mounted onto the reflector and facing to the mesh hood;

wherein the reflector is inclined from the bottom to the top and from front to rear, and the heater is inclined with the reflector in the vertical plane.

4. The electric radiator according to claim 3, wherein the air channel cover is located behind the reflector.

5. The electric radiator according to claim 3, wherein a plurality of the heaters are provided and each of the heaters is extended in the up-down direction, and the plurality of the heaters are spaced apart from each other in a left-right direction, the first temperature limiter is located in a middle of the plurality of the heaters in the left-right direction.

6. The electric radiator according to claim 3, wherein an isolation rib is disposed on the reflector and defines a receiving groove facing to the mesh hood, the heater is assembled in the receiving groove and the first temperature limiter is mounted onto the isolation rib.

7. The electric radiator according to claim 6, wherein a mounting groove is formed at the isolation rib, faces to the mesh hood and runs through the isolation rib in a thickness direction of the isolation rib, and the first temperature limiter is mounted in the mounting groove.

8. The electric radiator according to claim 3, wherein the air supply outlet is formed at the reflector and the air supply inlet is formed at the housing;

wherein the first temperature limiter is mounted onto the reflector and faces to the mesh hood.

9. The electric radiator according to claim 1, wherein the second temperature limiter is located at a bottom front of the first temperate limiter.

10. The electric radiator according to claim 9, wherein the second temperature limiter is located in a middle of the housing in a left-right direction.

11. The electric radiator according to claim 1, wherein the housing comprises: a front housing body, the heating assembly, the mesh hood and the second temperature limiter are mounted onto the front housing body respectively;

a rear housing body mounted onto the front housing body detachably, the air supply inlet being formed at the rear housing body.

12. The electric radiator according to claim 1, wherein the second temperature limiter is apart from the natural convection air channel in the housing.

* * * * *